US005310090A

United States Patent [19]

Taylor, Jr.

[11] Patent Number: 5,310,090

[45] Date of Patent: May 10, 1994

[54] DISHWASHER DETERGENT DISPENSER

[75] Inventor: Marion L. Taylor, Jr., Kinston, N.C.

[73] Assignee: White Consolidated Industries, Inc., Cleveland, Ohio

[21] Appl. No.: 39,956

[22] Filed: Mar. 30, 1993

[51] Int. Cl.[5] ..... B67D 5/56

[52] U.S. Cl. ..... 222/129; 222/651; 222/504; 134/58 D; 134/93

[58] Field of Search ..... 222/129, 651, 504; 134/56 D, 57 D, 58 D, 93

[56] References Cited

U.S. PATENT DOCUMENTS

| | | | |
|---|---|---|---|
| 3,565,291 | 2/1971 | Grandclement | 222/651 |
| 4,009,801 | 3/1977 | Williams | 134/93 X |
| 4,355,738 | 10/1982 | Herbst et al. | 222/129 |
| 4,794,750 | 12/1990 | Welch | 222/651 X |

FOREIGN PATENT DOCUMENTS

| | | | |
|---|---|---|---|
| 2305192 | 8/1973 | Fed. Rep. of Germany | 222/651 |

*Primary Examiner*—Gregory L. Huson

*Attorney, Agent, or Firm*—Pearne, Gordon, McCoy & Granger

[57] ABSTRACT

The present invention provides a dishwasher access-door mounted dishwasher detergent dispenser having an improved assembly. The dispenser includes an outer bow-tie shaped door which has a central shaft extending therefrom. The shaft extends through the access door, and through a stationary actuating member and a rotary cam and latch member. A terminal end of the shaft provides a transverse bore through which is loosely slip-fit a retaining pin. The cam and latch member includes a cylindrical hub and a projecting member. The cylindrical hub includes an upstanding cylindrical wall and a camming surface. The cylindrical wall, which extends above and generally surrounds the camming surface, defines a notched opening through which the terminal end of the shaft is accessible for insertion and removal of the slip fit pin mounted therein. The cylindrical wall surrounds or encloses opposite ends of the mounting pin and prevents the unintentional or accidental removal of the mounting pin from the shaft. The present invention improves upon designs which employ a frictional fit between the mounting pin and the shaft which results in fracture of the shaft or hub as a result of shaft hoop stress and the harsh environmental inherent in dishwashing machines.

12 Claims, 3 Drawing Sheets

Fig.1
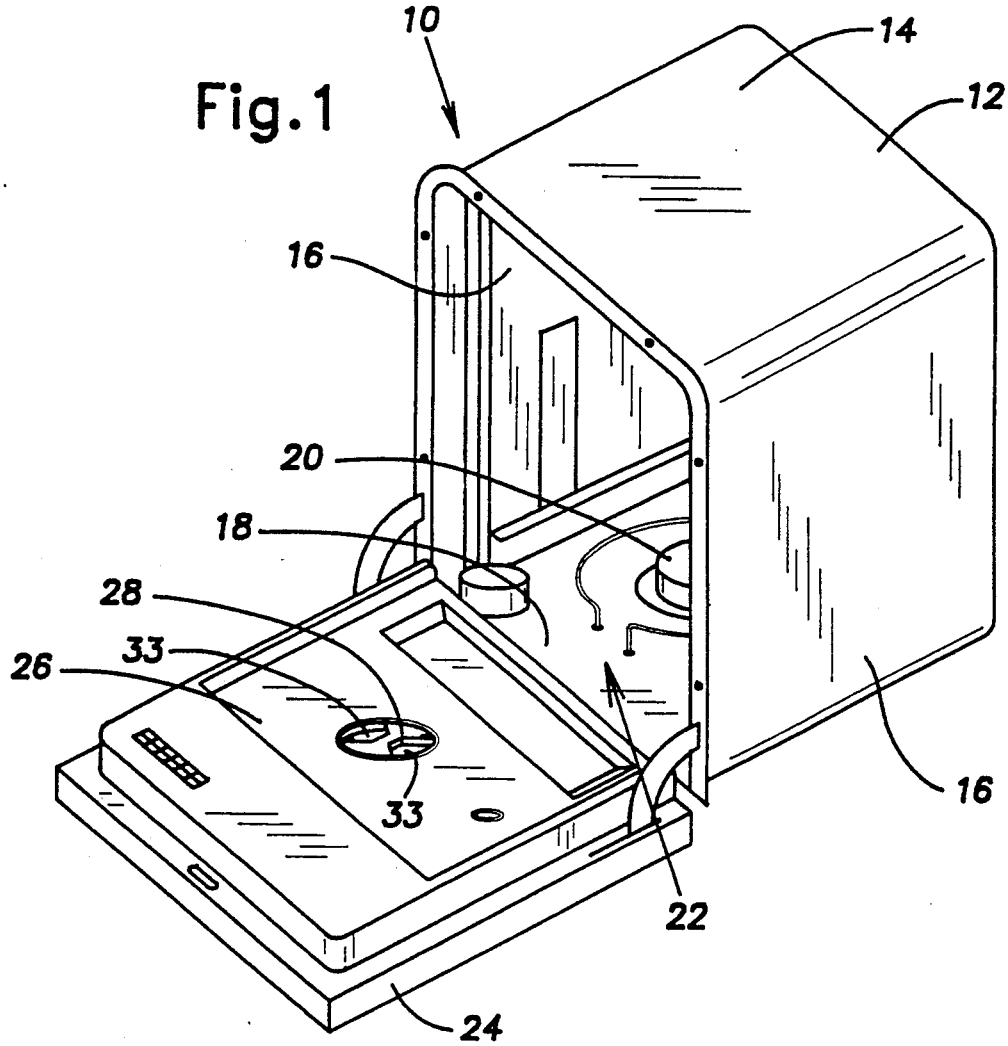
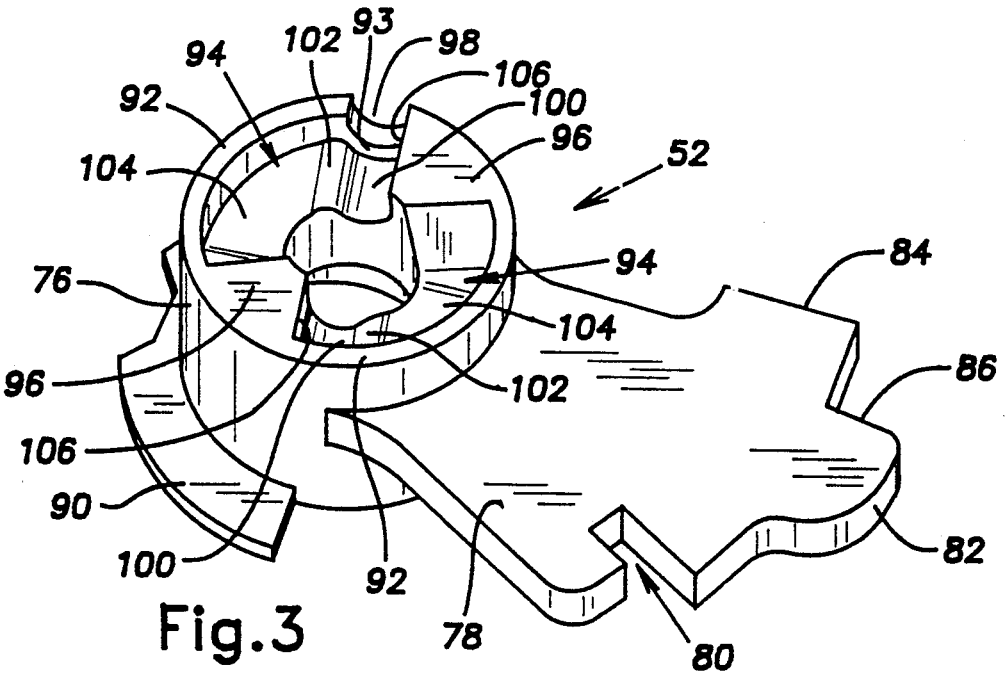
Fig.3

DISHWASHER DETERGENT DISPENSER

BACKGROUND OF THE INVENTION

1. Field of the Invention

The present invention generally relates to dispensers and, more particularly, to dishwasher detergent dispensers.

2. Description of the Related Art

In the past, it has been common to mount a detergent dispenser to a dishwasher access door. The detergent dispenser employs a dispenser door having a central shaft which extends through the inner panel of the dishwasher door, a stationary actuating member, and a rotary cam and latch member. Typically, the stationary actuating member includes means to release the rotary cam and latch member, which is spring biased by a rotary biasing spring, at a predetermined time in the wash cycle.

Conventionally, the dispenser shaft has a transverse hole into which is frictionally inserted a mounting pin. In the known detergent dispensers, the mounting pin is frictionally inserted to insure its retention within the transverse hole. This frictional fit is provided by closely matching the diameter of the mounting pin at a location along its length with the diameter of the transverse hole. Preferably, the diameter of the mounting pin is identical to that of the hole at this location, or slightly greater than that of the hole, to insure a tight or tension fit between the pin and the dispenser shaft.

Although the aforementioned design may work satisfactorily with some detergent dispensers, it has been found that when the dispenser door and shaft are made of certain materials, such as polypropylene, the door and shaft have a tendency to warp when subjected to the heat produced by the dishwashing machine and prematurely release detergent. If the temperature sensitive material is replaced by more temperature stable materials such as a polycarbonate alloy, the frictional or press-fit of the mounting pin and the dispenser door shaft creates hoop stress in the shaft which, in combination with the harsh environmental conditions encountered in the dishwashing machine, causes the shaft to fracture or break, and renders the detergent dispenser inoperable.

SUMMARY OF THE INVENTION

The present invention is directed toward a detergent dispenser assembly which eliminates the shortcomings of the aforementioned dispenser designs by incorporating a slip-fit mounting pin assembly with a temperature-stable material.

In accordance with the present invention, the detergent dispenser provides a detergent dispenser door having a pair of opposed outwardly extending sections and a centrally located shaft. The opposed sections are provided to cover or conceal a pair of similarly shaped detergent receiving compartments integrally provided by a dishwashing machine access door. The dispenser door shaft defines a transverse hole adjacent a terminal or outward end which is adapted to loosely and slidably receive a mounting pin. The detergent dispenser is made of a heat stable material such as a polycarbonate alloy.

The detergent dispenser also includes a stationary actuating member which includes a main body and a selectively actuatable latch. The main body has a spring receiving projection and a stop member. The projection receives a proximal end of a rotary biasing spring.

The detergent dispenser further includes a rotary cam and latch member which has a cylindrical hub and an outwardly extending projection. The outwardly extending projection includes a latch engaging surface, a stop member engaging surface and a notch. The notch is adapted to receive a hooked distal end of the rotary biasing spring. The cylindrical hub has a cylindrical outer wall, an outwardly extending flange, and a pair of camming surfaces.

Each of the camming surfaces include a semi-cylindrical recess, an upraised ridge, and a ramping surface. The outer wall extends above and generally surrounds the camming surfaces. The outer wall includes a semi-circular notch which is generally in-line with but upwardly spaced from the semi-cylindrical recesses defined by the camming surfaces.

An axial biasing spring outwardly biases the rotary cam and latch member and maintains opposite ends of the mounting pin, which extend or project out of the transverse hole, in constant contact with the camming surface provided by the cylindrical hub. The upstanding wall surrounds and retains the loosely received mounting pin and prevents it from unintentionally or accidentally falling out of the transverse hole. The mounting pin is loosely received within the dispenser shaft and, thus, does not create undesirable hoop stress in the shaft.

BRIEF DESCRIPTION OF THE DRAWINGS

These and further features of the present invention will be apparent with reference to the following description and drawings, wherein:

FIG. 1 is a perspective view of a dishwashing machine in accordance with the present invention;

FIG. 3 is a perspective view of a rotary cam and latch in accordance with the present invention;

DETAILED DESCRIPTION OF THE PREFERRED EMBODIMENT

Figure 2:
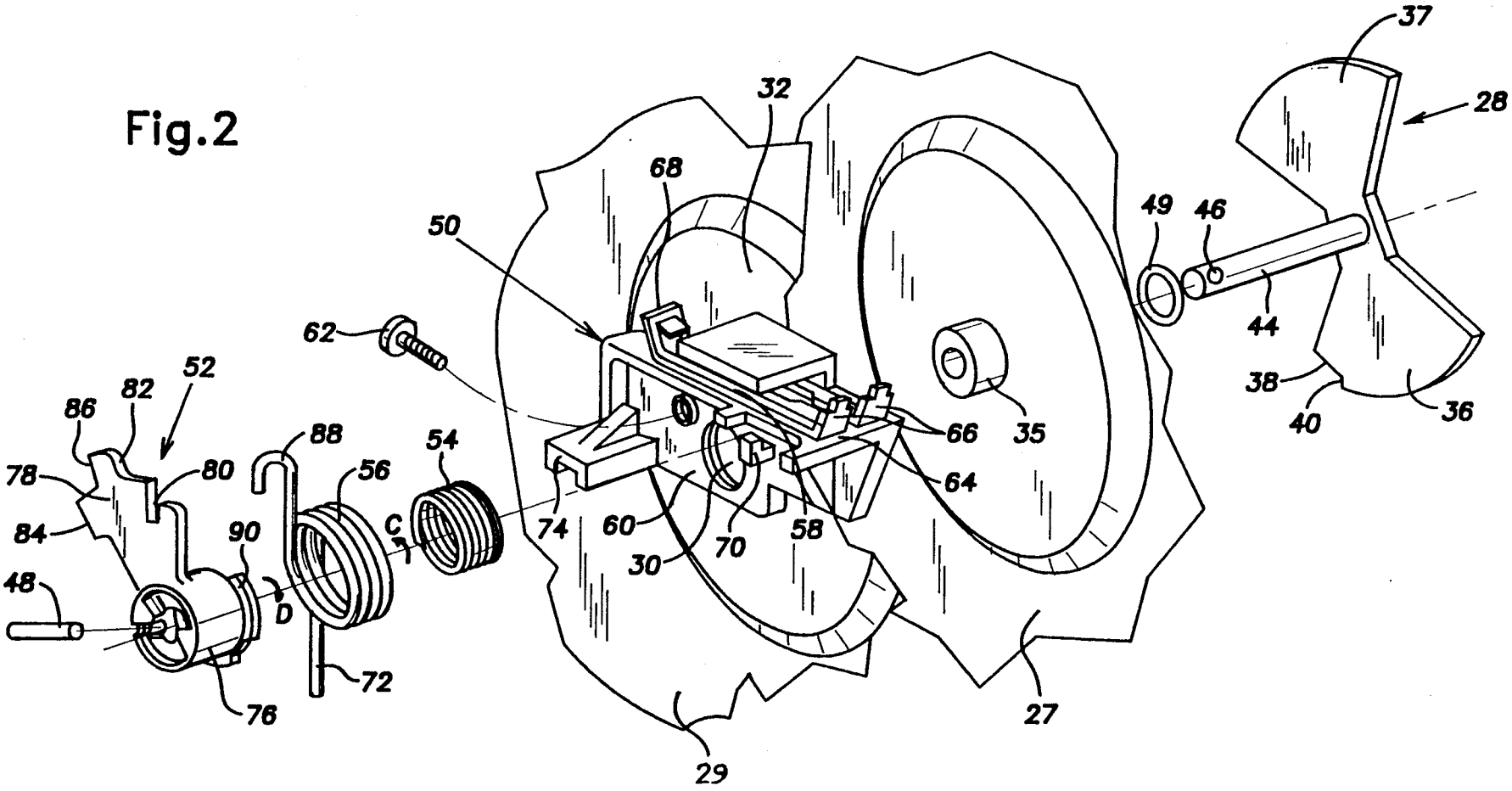
FIG. 2 is an exploded perspective view of a dishwasher detergent dispenser in accordance with the present invention.

With reference to the drawing figures and, in particular FIG. 1, a dishwashing machine 10 incorporating a dishwasher detergent dispenser according to the present invention is shown. The dishwashing machine includes a water retaining tub 12 which includes an upper wall 14, a pair of vertical side walls 16, a vertical rear wall (not shown), and a generally horizontal bottom wall 18 which defines a sump or reservoir for the retention of water during a dishwashing cycle.

The tub 12 defines an open front 22 which is sealably closed by a pivotally mounted access door 24. In FIG. 1, the access door is shown in an open position whereby access to the interior of the tub is permitted. During a wash or rinse cycle, a dishwasher pump 20 draws water from the sump and distributes it throughout the tub 12 via one or more rotatably mounted wash arms (not shown). During a drain cycle, the pump 20 draws water from the sump and delivers it to a sewer drain (not shown).

The access door 24 conventionally includes an outer decorative panel (not shown) and an inner fluid-impermeable panel 26. Various electro-mechanical control instruments such as door locks, timers, sensors, and dispensers, including the detergent dispenser of the present invention, are at least partially housed within the access door 24.

With reference to FIGS. 1, 2, 4 and 5, the inner panel 26 is shown to include a plastic outer wall 27 and a metal inner liner 29. The outer wall and inner liner generally nest together and are attached at several peripheral locations. The outer wall 27 has integrally molded therein a circular recess 32 which is segregated into first and second pairs 33, 34 of generally equal sized chambers or compartments. The compartments 33, 34 are designed to receive detergent to be dispensed into the interior of the dishwasher tub 12.

Generally coaxial with the circular recess 32, the outer wall 27 provides a short, rearwardly extending hollow shaft 35 which projects through a hole 30 in the inner liner 29, as shown best in FIG. 2. The short hollow shaft 35 allows a detergent dispenser door 28 to be rotatably mounted to the inner liner 29 and outer wall 27 of the inner panel 26, as will be apparent from the drawing figures and the description to follow.

The dispenser door 28 is generally bow-tie shaped, having first and second opposed wedge-shaped sections 36, 37 which are provided to selectively cover or overlie the first or second pair of similarly-shaped detergent containing chambers 33, 34. The first wedge-shaped section 36 provided by the dispenser door 28 includes a notched portion 38 which defines a first stop surface 40.

The first stop surface 40 engages an upstanding tab 42 on the outer wall 27 to limit rotation of the dispenser door 28. Preferably, the first stop surface 40 prevents the door from being over-rotated in a counter-clockwise direction (i.e., in the direction of arrow A in FIG. 4), as will be more fully described hereafter. A second stop surface 41 is provided on the second wedge-shaped section 37 of the dispenser door 28 to prevent over-rotation in a clockwise direction (i.e., in the direction of arrow B in FIG. 5).

Extending inwardly from the dispenser door is a centrally located elongated shaft 44. The shaft 44 projects through the short hollow shaft 35 provided by the outer wall 27 of the inner panel 26, generally toward the outer decorative panel of the access door 24. The shaft 44 includes a transverse or cross-wise directed bore 46 adjacent a distal end thereof which slidably and loosely receives a mounting pin 48, as will be described more fully hereafter. At a base of the shaft 44, the dispenser door 28 receives an O-ring seal 49 to prevent fluids such as water and detergent from leaking into the interior of the access door 24 during a dishwashing cycle.

The dishwasher detergent dispenser of the present invention generally includes the dispenser door 28, the mounting pin 48, a stationary actuating member 50, a rotary cam and latch member 52, an axial biasing spring 54, and a rotary biasing spring 56.

The actuating member 50 includes a main body 60 onto which is mounted a deformable bi-metal latching member 58. The bi-metal latching member 58, which is provided on an upper surface 64 of the main body 60, includes a pair of terminals 66 and a relatively upturned intermediate latching section 68 therebetween. The main body 60 is stationarily mounted or attached via a conventional fastener 62 to the inner liner 29 and outer wall 27 of the inner panel 26. The main body 60 defines an opening through which the short hollow shaft 35 and the dispenser door shaft 44 telescopically extend, as illustrated.

Beneath the bi-metal latching member 58, the main body provides a generally L-shaped projection 70. The L-shaped projection receives and retains a proximal end 72 of the rotary biasing spring 56, as will be described more fully hereafter. The main body also provides an outwardly extending stop member 74. The stop member 74 limits the rotational range of motion of the rotary cam and latch member 52.

The rotary cam and latch member 52 includes a cylindrical hub section 76 and an outwardly extending generally planar projection 78. The projection 78 provides a notch 80, a cam surface 82, a stop member engaging surface 84, and a bi-metal latch engaging surface 86.

The notch 80 is adapted to receive a hooked distal end 88 of the rotary biasing spring 56. The hooked distal end 86 of the rotary biasing spring is opposite the proximal end 72 retained by the L-shaped projection 70. The remainder of the rotary biasing spring 56 is wrapped around the hub section 76 between a lower semi-circular flange 90 and the outwardly extending projection 78.

When the distal end 86 of the spring is received within the notch 80 and the proximal end 72 is engaged with the L-shaped projection 70, the spring is under tension and biases the rotary cam and latch member 52 in the direction labeled with arrow C in FIG. 2. Naturally, the biasing force is relatively greater when the latch engaging surface 86 of the projection 78 is in engagement with the intermediate latching section 68 of the bi-metal latching member 58 than when the stop engaging surface 84 is in engagement with the stop member 74.

Figure 4:
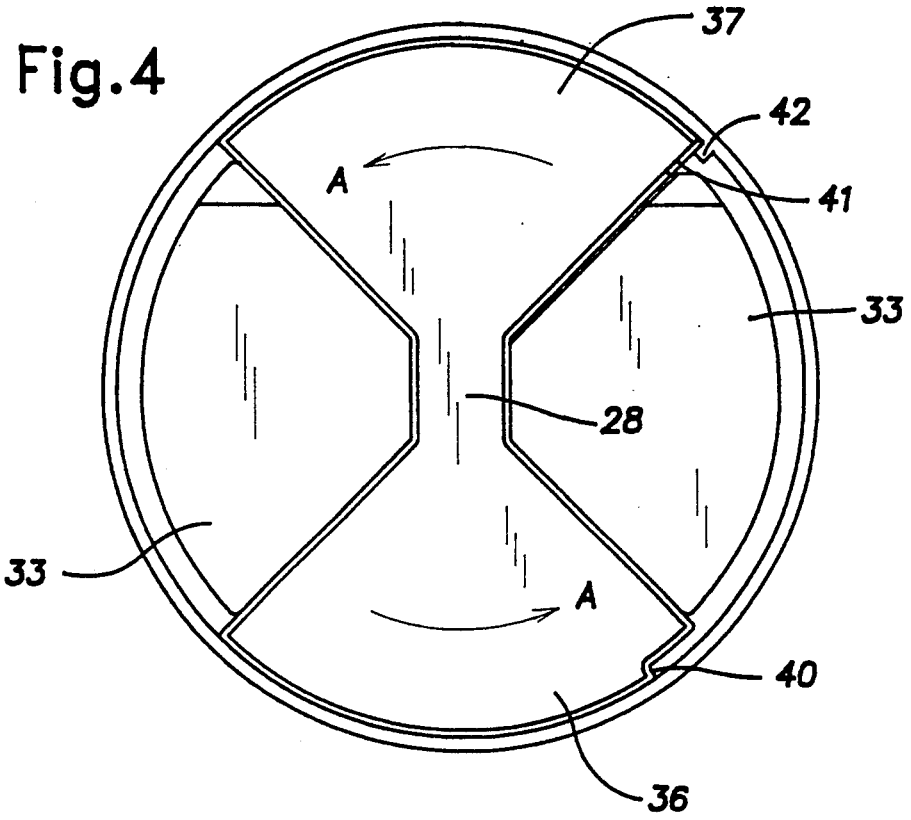
FIG. 4 is a plan view of a dispenser door in an at-rest position according to the present invention.
Figure 5:
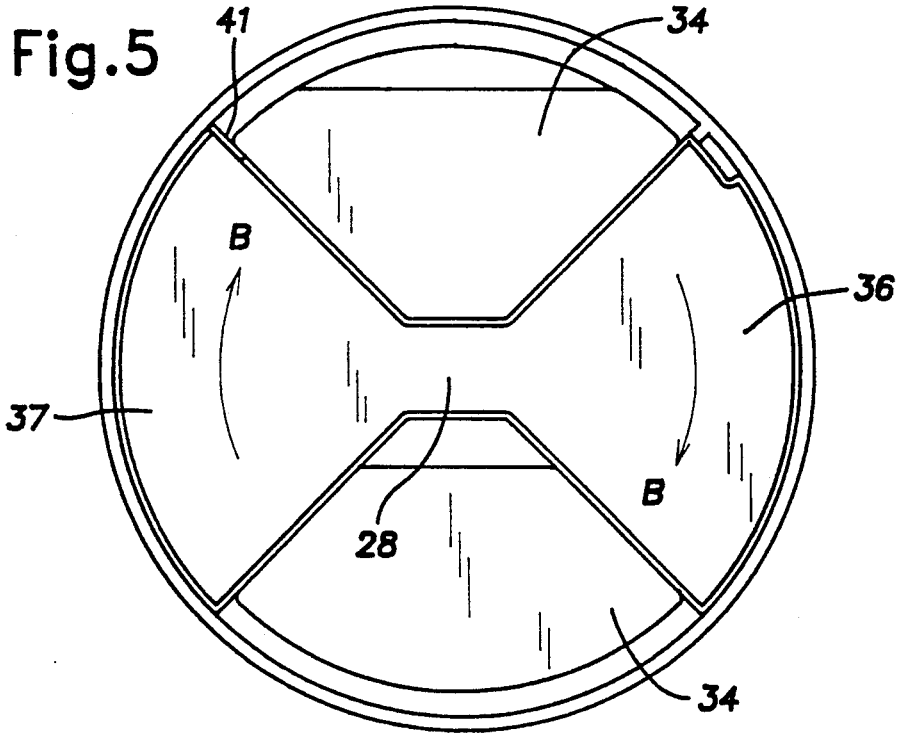
FIG. 5 is a plan view of the dispenser door in a spring-loaded position according to the present invention.

During movement of the dispenser door 28 in the counter-clockwise direction from the position shown in FIG. 4 to that of FIG. 5, (i.e., moving the dispenser door in the direction of arrow A in FIG. 4, or in the direction of arrow D in FIG. 2) the cam surface 82 of the projection 78 engages and upwardly cams the intermediate section 68 of the bi-metal latch 58 as the detergent dispenser door 28 is being moved into its spring-loaded position shown in FIG. 5. The latch engaging surface 86 contacts or bears against the intermediate portion 68 of the bi-metal latching member 58 when the dispenser door 28 and rotary cam and latch member 52 are in the spring-loaded condition, as will be described more fully hereafter. The stop member engaging surface 84 engages the stop member 74 provided by the main body 60 of the actuating member 50 when the dispenser door 28 and rotary cam and latch member 52 are in the at-rest position shown in FIG. 4.

With specific reference to FIG. 3, the hub section 76 includes a cylindrical outer wall 92, a pair of radially opposed ramping or camming surfaces 94, and a pair of opposed upstanding triangular-shaped sections 96. The cylindrical outer wall 92 is radially outwardly spaced from the opposed ramping or camming surfaces 94 and extends above the camming surfaces 94. The outer wall 92 defines a semi-circular notched opening 98 to facilitate insertion of the mounting pin 48 into the transverse hole 46 in the dispenser door shaft 44, as will be described hereafter.

The outer wall 92 provides a short vertical wall section 93 below the semi-circular notched opening 98 to prevent the mounting pin from falling out of the transverse hole 46 in the shaft 44 when opposite ends of the mounting pin 48 are received within a pair of semi-cylindrical recessed or notched portions 100. The remainder of the outer wall 92 which projects above the camming surfaces 94 prevents the slip-fit or loosely mounted pin 48 from inadvertently falling out of the transverse hole 46 in the shaft 44 when the mounting pin 48 is not received within the semi-cylindrical notched portions 100.

The opposed camming surfaces 94 are generally identical and, as will be described hereafter, each generally include one of the semi-cylindrical notched or recessed portions 100, an upraised bump or ridge 102, and a gently upwardly sloping or ramping portion 104. As shown best in FIG. 3, the notched or recessed portions 100 are generally in-line with, but relatively below, the semi-circular notched opening 98 in the cylindrical outer wall 92. One of the recessed portions terminates or intersects with the short vertical wall section 93, as illustrated.

Adjacent the recessed portions 100, the triangular-shaped sections 96 each define stops 106 which, in cooperation with opposite ends of the mounting pin 48, rotatably link or connect the hub section 76 and shaft 44 when the dispenser door is rotated in the direction of arrow A. The upraised bumps or ridges 102 are adjacent the recessed portions 100, and present an impediment or obstacle to rotation of the dispenser door 28 in the direction of arrow B which is overcome by a small amount of user-applied force. As will be apparent to one skilled in the art, the ridges 102 help retain the mounting pin 48 within the semi-cylindrical recesses 100. Each of the upwardly sloping portions 104 are adjacent the upraised ridges 102, and terminate or intersect with one of the triangular-shaped sections 96.

More than one-quarter counter-clockwise turn of the dispenser door 28 is possible between the recessed portion 100 and the wedge-shaped section 96. However, rotation of the door 28 in the direction of arrow B is limited by engagement of the stop surface 41 of the second wedge-shaped portion 37 with the upstanding tab 42, preventing rotation beyond one quarter counter-clockwise turn.

The detergent dispenser of the present invention is assembled in the following manner. With the inner panel assembled 26, and the actuating member 50 attached to the inner liner 29 of the access door 24, the dispenser door shaft 44, with the O-ring seal 49 in place thereon, is inserted through the short hollow shaft 35 provided by the outer wall 27. Preferably, following this preliminary step of assembly the dispenser door 28 is positioned generally as shown in FIG. 4.

The axial biasing spring 54 is placed over the dispenser door shaft 44 and engages the outer end of the hollow shaft 35. The cam and latch member 52, with the distal end 88 of the rotary biasing spring 56 received within the notch 80, is placed over the dispenser shaft 44 such that the axial biasing spring 54 is trapped between the cam and latch member 52 and the outer end of the hollow shaft 35. Thereafter, the proximal end 72 of the rotary biasing spring 56 is engaged with the L-shaped projection 70 of the main body member 60 and the stop engaging surface 84 is placed in contact with the stop surface 74.

The cam and latch member 52 is pushed against the bias of the axial biasing spring 54, compressing the spring and aligning the transverse hole 46 in the shaft 44 with the semi-circular notch 98 in the outer wall 92. After the mounting pin 48 is slidably inserted into the transverse hole 46 via the semi-circular notch 98, the cam and latch member 52 is released and allowed to move outwardly away from the actuating member 50 under the influence of the axial biasing spring 54.

Movement of the cam and latch member 52 away from the actuating member causes the opposite ends of the mounting pin 48 to be received within the semi-cylindrical notched or recessed portions 100 of the opposed camming surfaces 94. The end of the mounting pin beneath the semi-circular notched recess 98 is next to or abuts the short vertical wall section 93 and is thereby prevented from inadvertently falling out of the transverse hole 46 in the shaft 44.

As so assembled, the dishwasher dispenser is in the at-rest condition whereby the stop engaging surface 84 of the cam and latch member projection 78 is in engagement with the stop member 74 of the actuating member 50 and the dispenser door is generally as depicted in FIG. 4.

Prior to operation of the dishwasher incorporating the so-assembled detergent dispenser, a user will typically fill the accessible compartments 33 of the detergent dispenser when the dispenser is in the at-rest position and then rotate the dispenser door 28 to cover these compartments 33 and access the other pair of compartments 34. Therefore, after filling the accessible compartments 33, spring-loading of the detergent dispenser or, more specifically, the dispenser door 28 and the cam and latch member 52, is initiated by simply rotating the dispenser door 28 in the counter-clockwise direction against the bias of the rotary biasing spring 56.

Counter-clockwise rotation of the dispenser door 28 causes opposite ends of the mounting pin 48 to bear against the stop surfaces 106 of the triangular-shaped members 96, thereby forcing the cam and latch member 52 to rotate with the dispenser door. As the dispenser door 28 approaches the position shown in FIG. 5, the camming surface 82 of the projection 78 engages the intermediate latching section 68 of the bi-metal latch 58 and upwardly cams or deforms the intermediate section. Further rotation of the dispenser door 28 causes the intermediate section 68 to resiliently snap into engagement with the latch engaging surface 86 of the projection 78.

At this point, the dispenser door 28 and cam and latch mechanism 52 are in the spring-loaded condition, the dispenser door being generally as shown in FIG. 5. Only minimal further counter-clockwise rotation of the dispenser door is possible as the stop surface 40 provided by the first wedge-shaped section 37 of the door precludes over-rotation in counter-clockwise direction.

With the dispenser door 28 and cam and latch member 52 in the spring-loaded condition, the user fills the newly accessible compartments 34 with dishwashing detergent. However, if the user neglected to previously fill the now-covered compartments 33, the dispenser door can be clockwise rotated to expose these compartments.

Rotation of the dispenser door in the clockwise direction, i.e., in the direction of arrow B, causes the ends of the mounting pin 48 to move away from the triangular-shaped projections 96 and, with a small amount of user-applied force, ride over the upstanding ridges 102 of the camming surfaces 94. It should be noted that, since the cam and latch member 52 is in engagement with the bi-metal latch 58, it is not free to move with the dispenser door and, thus, the dispenser door 28 alone rotates while the cam and latch member 52 remains in the spring-loaded condition described hereinbefore.

Once over the ridges 102, the mounting pin 48 freely slides over the camming surface until the stop surface 41 of the second wedge-shaped section 37 engages the upstanding tab 42. As so positioned, the dispenser door 28 is generally in the position illustrated in FIG. 4, revealing the previously covered detergent receiving compartments 33. However, since the cam and latch member 52 is still in the spring-loaded position, the dispenser door is easily moved back to the position illustrated in FIG. 5 without having to again overcome the spring bias originally encountered in spring-loading the dispenser door 28. The mounting pin 28 is maintained in continuous contact with the camming surface 94 by the axial biasing spring 54.

In any event, with the dispenser door in the position illustrated in FIG. 5, and the dishwasher otherwise prepared for operation, the dishwasher is ready to be turned on. As conventionally operated, the detergent in the exposed compartments 34 is used during an initial wash cycle and the detergent in the compartments 33 covered by the dispenser door 28 is used in a second or subsequent wash cycle.

As is generally well known in the art, at the beginning of the second wash cycle, current flows through the bi-metal latching member 58 and causes the intermediate latching section 68, which is in engagement with the cam and latch member 52, to deform or move upwardly. Upward movement of the intermediate latching section 68 allows the rotary cam and latch member 52 to rotate under spring bias in the direction of arrow C until the stop engaging surface 84 contacts the stop member 74.

As the cam and latch member 52 rotates, the stops 106 provided by the triangular-shaped sections 96 bear against the opposite ends of the mounting pin 48 and the rotational motion of the cam and latch member 52 is transferred to the door 28. The door moves in the direction of arrow B from a position generally covering the first pair of detergent compartments 33 (FIG. 5) to a position generally revealing the detergent within these compartments (FIG. 4).

Regardless of the radial position of the dispenser door, terminal ends of the mounting pin 48 are always radially surrounded by the upstanding wall 92 provided by the hub section 76 of the cam and latch member 52. The upstanding wall 92, in conjunction with the axial biasing spring 54 which maintains the mounting pin in continuous contact with the camming surface 94, prevents the mounting pin 48, which is loosely received within the transverse hole 46 in the shaft 44, from inadvertently or accidentally sliding out of the hole 46.

To disassemble the detergent dispenser, the cam and latch member 52 is moved or pushed toward the inner liner 29 against the bias of the axial biasing spring 54 to bring the mounting pin 48 into alignment with the semicircular notch 98 in the upstanding wall 92. Thereafter, the mounting pin is easily grasped and slidably removed from the transverse hole in the shaft 44.

While the preferred embodiment of the present invention is shown and described herein, it is to be understood that the same is not so limited but shall cover and include any and all modifications thereof which fall within the purview of the invention.

What is claimed is:

1. A detergent dispenser, said detergent dispenser being attached to a dishwasher access door, said dispenser comprising:

a rotary biasing spring, said spring comprising proximal and distal ends;

a detergent dispenser door, said dispenser door including a user manipulated section and a generally centrally located shaft, said user manipulated section being designed and sized to selectively cover a detergent-receiving compartment provided by said access door, said shaft providing a transverse bore near a terminal end thereof, said bore having a first diameter and being adapted to loosely and slidably receive a mounting pin, said mounting pin having a second diameter, wherein said second diameter is less than said first diameter and said mounting pin is sized such that opposite ends of said pin project out of said transverse bore;

a stationary actuating member, said actuating member comprising a main body and a selectively actuatable latch, said main body providing a spring receiving projection and a stop member, said projection receiving a proximal end of said rotary biasing spring;

a rotary cam and latch member, said cam and latch member comprising a cylindrical hub and an outwardly extending projection, said outwardly extending projection including a latch engaging surface, a stop member engaging surface, and a notch, said notch receiving the distal end of said rotary biasing spring, said cylindrical hub comprising a cylindrical outer wall, and a camming surface, wherein said outer wall extends above and surrounds said camming surface and defines an opening to allow insertion of the mounting pin into the transverse bore provided by the shaft while the upstanding wall prevents the mounting pin from unintentionally or accidentally falling out of the transverse bore, said hub also defining a lengthwise-directed bore through which the dispenser door shaft projects, wherein when the dispenser door and cam and latch member are in an at-rest position, the stop member engaging surface is in engagement with the stop surface of the main body and, when the dispenser door and cam and latch member are in a spring-loaded position, the latch engaging surface is in engagement with, and retained by, the actuatable latch provided by the stationary actuating member, said actuatable latch releasing said latch engaging surface at a predetermined time to allow the user manipulated section of said dispenser door to move from a position generally covering the detergent-receiving compartment to a position generally exposing said detergent-receiving compartment.

2. A detergent dispenser according to claim 1, wherein said user manipulated section comprises a pair of opposed, outwardly extending sections, each of said opposed sections providing a stop surface, said stop surfaces being adapted to engage a tab provided by the access door to limit rotational motion of said dispenser door.

3. A detergent dispenser according to claim 1, wherein said hub also includes an outwardly extending flange, a substantial portion of said rotary biasing spring being wrapped around said cylindrical hub between said outwardly extending flange and said projection.

4. A detergent dispenser according to claim 1, further comprising an axial biasing spring, said axial biasing spring being located between said stationary actuating member and said rotary cam and latch member and being operable to outwardly bias said cam and latch member away from said stationary member and thereby maintain the mounting pin in constant contact with the camming surface provided by said cylindrical hub.

5. A detergent dispenser according to claim 1, wherein said camming surface comprises a recessed notch and a ramping surface, said notched opening in the outer wall being generally in line with, but upwardly spaced from, said recessed notch.

6. A detergent dispenser according to claim 1, wherein said actuatable latch is a bi-metal latching member, said bi-metal latching member including a latching section which engages the latch engaging surface.

7. A detergent dispenser, said detergent dispenser being attached to a dishwasher access door, said dispenser comprising:

a rotary biasing spring, said spring comprising proximal and distal ends;

a detergent dispenser door, said dispenser door including a user manipulated section and a generally centrally located shaft, said user manipulated section being designed and sized to selectively cover a detergent-receiving compartment provided by said access door, said shaft providing a transverse bore near a terminal end thereof, said bore having a first diameter and being adapted to loosely and slidably receive a mounting pin, said mounting pin having a second diameter, wherein said second diameter is less than said first diameter and said mounting pin is sized such that opposite ends of said pin project out of said transverse bore;

a stationary actuating member, said actuating member comprising a main body and a selectively actuatable latch, said main body providing a spring receiving projection and a stop member, said projection receiving a proximal end of said rotary biasing spring, said actuatable latch comprising a bi-metal latching member, said bi-metal latching member including a latching section intermediate a pair of terminals;

a rotary cam and latch member, said cam and latch member comprising a cylindrical hub and an outwardly extending projection, said outwardly extending projection including a latch engaging surface, a stop member engaging surface, and a notch, said notch receiving the distal end of said rotary biasing spring, said cylindrical hub comprising a cylindrical outer wall, and a camming surface, wherein said outer wall extends above and surrounds said camming surface and defines an opening to allow insertion of the mounting pin into the transverse bore provided by the shaft while the upstanding wall prevents the mounting pin from unintentionally or accidentally falling out of the transverse bore, said hub also defining a lengthwise-directed bore through which the dispenser door shaft projects;

an axial biasing spring, said axial biasing spring being located between said stationary actuating member and said rotary cam and latch member and being operable to outwardly bias said cam and latch member away from said stationary member and thereby maintain the mounting pin in constant contact with the camming surface provided by said cylindrical hub, wherein when the dispenser door and cam and latch member are in an at-rest position, the stop member engaging surface is in engagement with the stop surface of the main body and, when the dispenser door and cam and latch member are in a spring-loaded position, the latch engaging surface is in engagement with, and retained by, the latching section provided by the bi-metal latching member of the stationary actuating member, said latching section releasing said latch engaging surface at a predetermined time to allow the user manipulated section of said dispenser door to move from a position generally covering the detergent-receiving compartment to a position generally exposing said detergent-receiving compartment.

8. A detergent dispenser according to claim 7, wherein said user manipulated section comprises a pair of opposed, outwardly extending sections, each of said opposed sections providing a stop surface, said stop surfaces being adapted to engage a tab provided by the access door to limit rotational motion of said dispenser door.

9. A detergent dispenser according to claim 7, wherein said hub also includes an outwardly extending flange, a substantial portion of said rotary biasing spring being wrapped around said cylindrical hub between said outwardly extending flange and said projection.

10. A detergent dispenser according to claim 7, wherein said camming surface comprises a recessed notch and a ramping surface, said notched opening in the outer wall being generally in line with, but upwardly spaced from, said recessed notch.

11. A detergent dispenser, said detergent dispenser being attached to a dishwasher access door, said dispenser comprising:

a rotary biasing spring, said spring comprising proximal and distal ends;

a detergent dispenser door, said dispenser door including a pair of opposed, outwardly extending sections and a generally centrally located shaft, said opposed sections being designed and sized to selectively cover a pair of detergent-receiving compartments provided by said access door, said shaft providing a transverse bore near a terminal end thereof, said bore having a first diameter and being adapted to loosely and slidably receive a mounting pin, said mounting pin having a second diameter, wherein said second diameter is less than said first diameter and said mounting pin is sized such that opposite ends of said pin project out of said transverse bore;

a stationary actuating member, said actuating member comprising a main body and a selectively actuatable latch, said main body providing a spring receiving projection and a stop member, said projection receiving a proximal end of said rotary biasing spring, said main body further defining an opening through which the dispenser door shaft extends, said actuatable latch comprising a bi-metal latch having a pair of terminals and a deformable intermediate latching member;

a rotary cam and latch member, said cam and latch member comprising a cylindrical hub and an outwardly extending projection, said outwardly extending projection including a latch engaging surface, a stop member engaging surface, and a notch, said notch receiving the distal end of said rotary biasing spring, said cylindrical hub comprising a cylindrical outer wall, an outwardly extending flange, and a camming surface, said camming surface comprising a recessed notch and a ramping surface, wherein said outer wall extends above said camming surface and defines an opening generally in line with, but upwardly spaced from, said recessed notch, said opening allowing insertion of the mounting pin into the transverse bore provided by the shaft while the upstanding wall prevents the mounting pin from unintentionally or accidentally falling out of the transverse bore, said hub also defining a lengthwise-directed bore through which the dispenser door shaft projects;

an axial biasing spring, said axial biasing spring being located between said stationary actuating member and said rotary cam and latch member and being operable to outwardly bias said cam and latch member away from said stationary member and thereby maintain the mounting pin in contact with the camming surface provided by said cylindrical hub, a substantial portion of said rotary biasing spring being wrapped around said cylindrical hub between said flange and said projection, wherein, when the dispenser door and cam and latch member are in an at-rest position, the stop member engaging surface is in engagement with the stop surface of the main body and, when the dispenser door and cam and latch member are in a spring-loaded position, the latch engaging surface is in engagement with, and retained by, the deformable intermediate latching member provided by the stationary actuating member, said latching member being deformed to release said latch engaging surface at a predetermined time to allow cam and latch member to move under spring bias, thereby allowing said dispenser door shaft and outwardly extending sections to rotate, said outwardly extending sections moving from a position generally covering the pair of detergent-receiving compartments to a position generally exposing said pair of detergent-receiving compartments.

12. A detergent dispenser according to claim 11, wherein each of said opposed sections provide a stop surface, said stop surfaces being adapted to engage a tab provided by the access door to limit rotational motion of the dispenser door.

* * * * *